United States Patent [19]

Inoue et al.

[11] 4,077,346

[45] Mar. 7, 1978

[54] METHOD OF PRODUCING STORAGE TANK SUPPORT BLOCK FOR LOW TEMPERATURE LIQUIFIED GAS CARRYING VESSELS

[75] Inventors: Takehiko Inoue; Junichi Tabata; Hidekatsu Ohishi; Seiichiro Murata, all of Osaka, Japan

[73] Assignee: Hitachi Shipbuilding & Engineering Co., Ltd., Osaka, Japan

[21] Appl. No.: 733,074

[22] Filed: Oct. 18, 1976

[30] Foreign Application Priority Data

Oct. 20, 1975 Japan .....50-126594

[51] Int. Cl.[2] ..... B63B 25/08

[52] U.S. Cl. ..... 114/74 A; 114/74 R; 52/122; 220/901; 248/188.3

[58] Field of Search ..... 114/74 R, 74 A, 72; 248/188.4, 19; 52/365, 298, 309, 122, 126; 264/212, 219, 262; 220/15, 9 R, 9 A, 9 LG

[56] References Cited

U.S. PATENT DOCUMENTS

| | | | |
|---|---|---|---|
| 2,579,447 | 12/1951 | Boucher | 52/122 |
| 2,792,959 | 5/1957 | Diamond | 220/15 |
| 2,812,834 | 11/1957 | LeJeune | 52/122 |
| 3,071,094 | 1/1963 | Leroux | 114/74 A |
| 3,424,413 | 1/1969 | Applegate | 248/188.4 |
| 3,998,062 | 12/1976 | Lange | 248/188.3 |

*Primary Examiner*—Trygve M. Blix
*Assistant Examiner*—D. W. Keen
*Attorney, Agent, or Firm*—Joseph W. Farley

[57] ABSTRACT

With a storage tank temporarily held in the correct position, an abutment plate is applied to the lower surface of each of support chocks projecting from a plurality of places circumferentially of the storage tank toward a support deck and in this condition such adjusting plates are temporarily fixed at the support deck as by bolts. A molding flask for preventing the outflow of resin material is placed to surround each abutment plate. Subsequently, a liquid resin material which, upon setting, becomes resistant to pressure and low temperature is poured into a space surrounded with the molding flask between the abutment plate and the support deck. After the resin has set, the storage tank is in the correctly installed condition supported by a support block formed of the resin. The upper surface of the support block serves as a slide surface provided by the abutment plate.

12 Claims, 4 Drawing Figures

METHOD OF PRODUCING STORAGE TANK SUPPORT BLOCK FOR LOW TEMPERATURE LIQUIFIED GAS CARRYING VESSELS

The present invention relates to a storage tank supporting device wherein in a low temperature liquefied gas carrying vessel, support legs on the storage tank side are placed for support on support blocks on the hull side, and it also relates to a method of constructing such support block.

For example, storage tank supporting devices for low temperature liquefied gas carrying vessels having a spherical or cylindrical tank include a type in which support chocks projecting from a plurality of places circumferentially of the storage tank are slidably placed on a support deck provided on the middle stage in the hold, whereby the load of the storage tank is supported by the support blocks while allowing the expansion and contraction of the tank. These devices consisting of said support chocks and support blocks are disposed at a plurality of places circumferentially of the tank, and moreover it is necessary that all their support surfaces and surfaces to be supported are in surface contact with each other uniformly over the entire area. In practice, however, with these devices used in as-worked condition, it is difficult to achieve the correctly installed condition described above because of distortions in the tank, hull and support devices produced during working. Therefore, eccentric concentrated loads are produced and in order to distribute them dimensional adjustment of the support devices is required, but when the tank is gigantic such adjustment is not easy, while an arrangement which allows easy dimensional adjustment would be very expensive.

The main object of the present invention is to provide a storage tank supporting device which solves all such problems, and in the concrete, it proposes a method of constructing a support block therefor. Thus, the invention proposes a method of constructing a support block for a support device in which a support leg projecting from a storage tank is supported on such support block, said method comprising the steps of temporarily supporting the storage tank at a predetermined position, temporarily fixing an abutment plate at an adjusted height so as to be in uniform contact with the lower surface of a support leg of said storage tank, attaching a molding flask to the hull side support surface around said abutment plate so as to surround the latter, and pouring, into a space defined by the molding flask, the abutment plate and the hull side support surface, a liquid resin material which, upon setting, becomes resistant to pressure and low temperature. According to this method, since such support block is formed in conformity with the associated support leg with the tank temporarily supported in its installed condition, the tank can be correctly supported in the hold even if there are distortions in the tank and the hull. Further, the abutment plate defines the upper surface of the resin-filled space and can be utilized as a slide surface for the support leg.

According to a desirable embodiment, the height adjustment and temporary fixing of said abutment plate is effected by manipulation of adjusting bolts interposed between the abutment plate and the hull side support surface. Further, as for said resin material, use is made of thermoplastic or self-setting epoxy type resins or silicone rubber type resins.

Other numerous features and merits of the invention will be readily understood from the following description of preferred embodiments of the invention with reference to the accompanying drawing.

IN THE DRAWINGS

Figure 1:
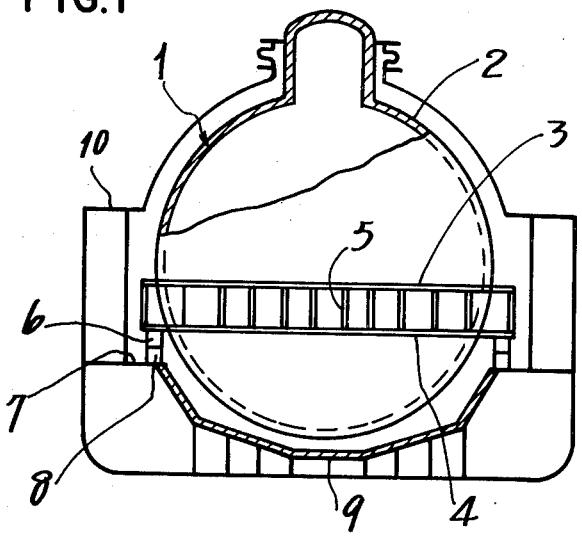
FIG. 1 is a partly broken-away cross-sectional view of a low temperature liquified gas carrying vessel having a spherical tank.

In FIG. 1, the numeral 1 designates a spherical storage tank; 2, a heat insulating device attached to the outer surface of the storage tank; 3 and 4, upper and lower support rings horizontally projecting from the outer surface of the tank 1 in a region in the vicinity of the tank equator and in a second circumferential region therebelow, respectively; and 5 designates stiffeners interposed between the upper and lower support rings 3 and 4. Designated at 6 are circumferentially equispaced support chocks attached to the lower surface of the lower support ring 4 and slidably mounted on support blocks 8 provided on a support deck 7. In this way, the tank 1 is supported on the support deck 7 while being allowed to thermally expand and contract. A pressure-resistant heat insulating material is interposed between said support chocks 6 and support blocks 8 and/or the support blocks are made of a pressure-resistant heat insulating material. Designated at 9 is the bottom wall of the hold, and usually a secondary heat insulating device is provided on the upper surface of said bottom wall. The numeral 10 designates an upper deck.

In such low temperature liquefied gas carrying vessel, according to an embodiment of the invention, each of said support chocks 6 is externally provided with a heat insulating material 11, and the lower surface of the chock provides a flat slide surface 11*a*. The tank mounted within the hold is supported at the correct position by separate means, and an abutment plate 8 having a plurality of height adjusting means 12 is placed on the support deck 7 in opposed relation to said support chock 6.

Figure 2:
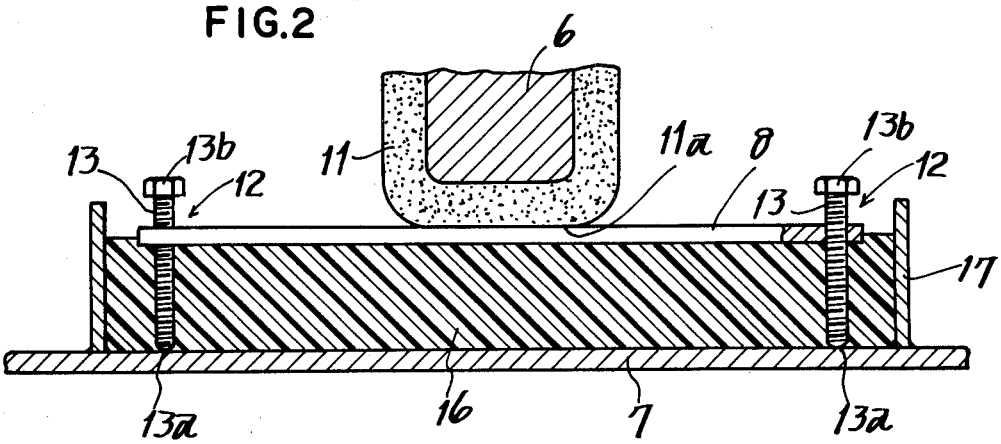
FIG. 2 is a front view, partly in section, of a tank supporting device.
Figure 3:
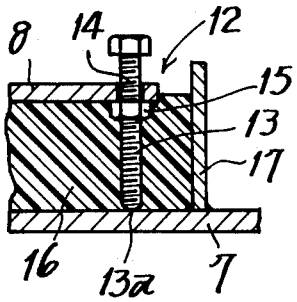
FIGS. 3 and 4 are sectional views showing the principal portions of modifications of the tank supporting device.
Figure 4:
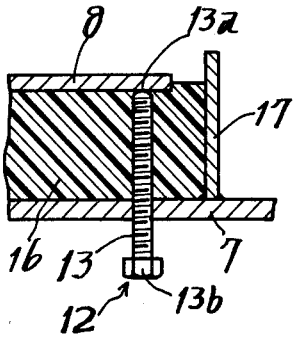

As such height adjusting means 12, there is employed a type in which, as shown in FIG. 2, bolts 13 are used which are capable of abutting against the support deck 7 at their front ends 13*a* and are screwed into the abutment plate 8, with their heads 13*b* exposed above the abutment plate 8 for manipulation; a second type in which, as shown in FIG. 3, bolts 13 extending through openings 14 formed in the abutment plate 8 are screwed into nuts 15 fixed to the bottom surface of the abutment plate 8; or a third type in which, as shown in FIG. 4, bolts 13 are screwed into the support deck 7, with their front ends 13*a* abutted to the bottom surface of the abutment plate 8, and their heads 13*b* exposed below the support deck 7 for manipulation. As for the material of the height adjusting means 12, a thermally non-conductive material such as resin is preferable.

After the abutment plate 8 is brought into contact with the slide surface 11*a* of the support chock 6 by the height adjusting means 12, an outflow-preventive molding flask 17 is placed therearound. After such height adjustment of the abutment plate 8 is made for each support block, a liquid resin is poured into a space between the abutment plate 8 and the support deck 7 within the outflow-preventive molding flask 17 to form a pressure- and low-temperature-resistant synthetic resin layer 16.

As for the materials for forming such synthetic resin layer 16, those which are thermoplastic or those which are of the self-setting type in which they spontaneously dry and set when coming in contact with air may be used.

To cite one example, to 50 parts of a bisphenol type epoxy resin expressed by the formula,

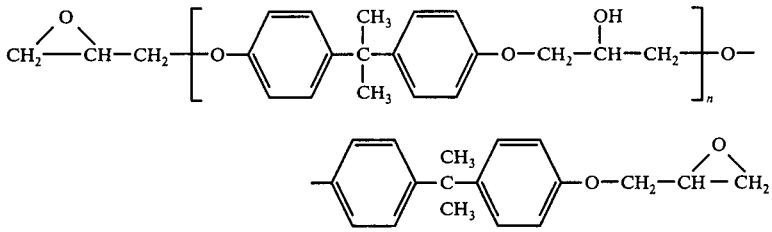

are added 50 parts of a mixture of calcium sulfate ($CaSO_4$), quartz powder ($SiO_2$) and aluminum hydroxide ($Al(OH)_3$) and then added, as a setting agent, are 100 parts of an aliphatic primary amine, such as ethylenediamine, ($H_2N—CH_2—CH_2—NH_2$), diethylenetriamine ($H_2N—CH_2—CH_2—NH—CH_2—CH_2—NH_2$) or diethylamino propylamine

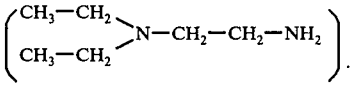

In this case, it withstands low temperatures of $-70°$ to $-80°$ C and has a pressure resistance of about 13 $Kg/mm^2$. For the synthetic resin layer 16, any material will do, provided that upon setting from a liquid state, it becomes resistant to pressure and low temperature. Therefore, besides the example cited above, silicone rubber type resins may be used.

We claim:

1. A method of constructing a support for slidably supporting a spherical low temperature liquified gas storage tank on a support deck in the hold of a ship, said spherical tank having a support ring in the vicinity of the tank's equator and a plurality of support legs projecting from the lower surface of the support ring at circumferentially spaced intervals, said method comprising the steps of:

temporarily supporting the storage tank in a predetermined position relative to said support deck;

temporarily fixing a plurality of abutment plates on said support deck at adjusted heights so that said abutment plates uniformly and slidably contact said support legs;

attaching a plurality of molding flasks to said support deck so that each of said molding flasks surrounds one of said abutment plates; and pouring into the spaces defined by said support deck, each of said molding flasks and each of said abutment plates a liquid resin material which upon setting becomes resistant to pressure and low temperature.

2. A method of construction as set forth in claim 1, wherein said step of adjusting the height of said abutment plates and temporarily fixing said abutment plates comprises manipulating adjusting bolts inserted into said abutment plates from above and having their lower ends abutting against said support deck.

3. A method of construction as set forth in claim 1, wherein said step of adjusting the height of said abutment plates and temporarily fixing said abutment plates comprises manipulating adjusting bolts inserted from below into said support deck, the upper ends of said bolts abutting against the lower surface of said abutment plates.

4. A method of construction as set forth in claim 1, wherein said step of attaching said molding flasks comprises welding said molding flasks to said support deck.

5. In a construction for slidably supporting a spherical low temperature liquified gas storage tank on a support deck in the hold of a ship, including a support ring provided on said spherical tank in the vicinity of its equator and a plurality of support legs projecting from the lower surface of the support ring at circumferentially spaced intervals, the improvement comprising:

supporting means carried by said support deck for slidably engaging said support legs;

said supporting means including a plurality of abutment plates, each of said abutment plates being slidably engageable by one of said support legs;

adjusting means for adjusting the height of each of said abutment plates relative to said support deck whereby the load of the storage tank is uniformly distributable on said supporting means;

a plurality of molding flasks, each of said molding flasks being welded to said support deck in surrounding relation with one of said abutment plates; and a pressure and low temperature resistant resin filling the space defined by said support deck, each of said molding flasks and each of said abutment plates and fixing said abutment plates in adjusted heat insulating relation to said support deck and relative to said support legs.

6. A construction as set forth in claim 5, wherein said adjusting means comprises adjusting bolts installed between said abutment plates and said support deck.

7. A construction as set forth in claim 6, wherein said adjusting bolts are screwed into the marginal portion of each of said abutment plates from above, with their front ends abutting against said support deck.

8. A construction as set forth in claim 6, wherein said adjusting bolts are screwed from below into said support deck, with their front ends abutting against said abutment plates.

9. A construction as set forth in claim 5, wherein said pressure and low temperature resistant resin material is thermoplastic or self-setting.

10. A construction as set forth in claim 9, wherein said pressure and low temperature resistant resin material is a silicone rubber type resin.

11. A construction as set forth in claim 9, wherein said pressure and low temperature resistant resin material is an epoxy type resin.

12. A construction as set forth in claim 11, wherein said pressure and low temperature resistant resin material consists of 50 parts of a bisphenol type epoxy resin, 50 parts of a mixture of calcium sulphate, quartz powder and aluminum hydroxide, and 100 parts of an aliphatic primary amine serving as a setting agent.

* * * * *